US011369167B1

(12) United States Patent
Mayer et al.

(10) Patent No.: US 11,369,167 B1
(45) Date of Patent: Jun. 28, 2022

(54) BOOT STORAGE ATTACHMENT SYSTEM AND METHOD OF USE

(71) Applicants: Melissa Mayer, Arvada, CO (US); Margot Binetti, Grand Junction, CO (US)

(72) Inventors: Melissa Mayer, Arvada, CO (US); Margot Binetti, Grand Junction, CO (US)

( * ) Notice: Subject to any disclaimer, the term of this patent is extended or adjusted under 35 U.S.C. 154(b) by 0 days.

(21) Appl. No.: 16/380,394

(22) Filed: Apr. 10, 2019

Related U.S. Application Data

(60) Provisional application No. 62/655,416, filed on Apr. 10, 2018.

(51) Int. Cl.
*A43C 19/00* (2006.01)
*A43B 23/02* (2006.01)

(52) U.S. Cl.
CPC ..... *A43C 19/00* (2013.01); *A43B 23/02* (2013.01)

(58) Field of Classification Search
CPC ..... A43C 19/00; A43B 1/0054; A43B 3/0031; A45C 11/321
USPC ..... 36/1, 132, 136
See application file for complete search history.

(56) References Cited

U.S. PATENT DOCUMENTS 348,233 A * 8/1886 Phalan ..... A43B 23/0245 36/1
1,213,036 A * 1/1917 Taylor ..... A43B 3/0031 36/1
1,289,341 A * 12/1918 Wirsching ..... A43B 3/0031 36/1
1,342,149 A * 6/1920 Avis ..... A43B 3/0031 36/1
D369,458 S * 5/1996 Adams ..... D2/946
6,264,079 B1 * 7/2001 Skaggs ..... F41C 33/0236 224/193
D447,619 S * 9/2001 Carey ..... D2/905
7,721,470 B2 * 5/2010 Long ..... A41D 27/08 36/136
D865,339 S * 11/2019 Elphick ..... D2/946
2003/0101625 A1 * 6/2003 Wu ..... A43B 3/0078 36/136
2005/0198872 A1 * 9/2005 Correa ..... F41C 33/041 36/136
2018/0279749 A1 * 10/2018 Quillmann ..... A45F 5/02
2018/0347941 A1 * 12/2018 Mandelbaum ..... A43B 3/00

* cited by examiner

*Primary Examiner* — Ted Kavanaugh
(74) *Attorney, Agent, or Firm* — Leavitt Eldredge Law Firm

(57) ABSTRACT

A boot storage attachment system includes a boot; a storage attachment, having a body forming an inner cavity; and a strap attached to the body and having a closure; the strap and closure are to secure the storage attachment to a side of the boot with the body being secured within an interior of the boot or on an exterior of the boot.

4 Claims, 5 Drawing Sheets

BOOT STORAGE ATTACHMENT SYSTEM AND METHOD OF USE

BACKGROUND

1. Field of the Invention

The present invention relates generally to boots and storage systems, and more specifically, to a boot storage attachment system for providing a convenient means of carrying one or more items within a boot, while the boot is being worn.

2. Description of Related Art

Boots and storage systems are well known in the art. For example, FIG. 1 depicts a conventional boot 101 having body 103 with an opening 105 into an inner cavity in which the user places their foot. It is common for boots to be worn during activities such as dancing, and events, such as rodeos and the like. Many times, the wearers do not want to carry a purse or bag with them during these events, and therefore it is desirable to have a boot and storage system that allows a user to conveniently carry small items, such as cash, credit cards, and/or a phone within their boots.

Accordingly, although great strides have been made in the area of boots and storage systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
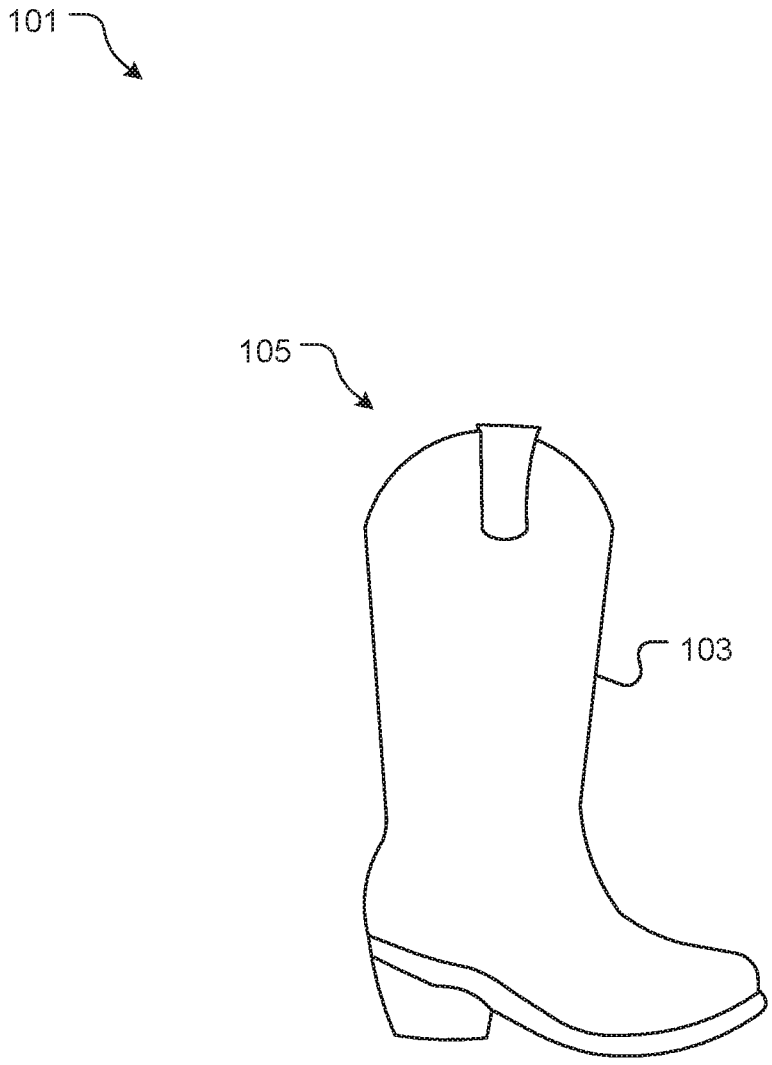
FIG. 1 (Prior Art)
FIG. 1 is a side view of a common boot.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional boot and storage systems. Specifically, the present invention provides a convenient means to carry small items securely within a boot. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2A:
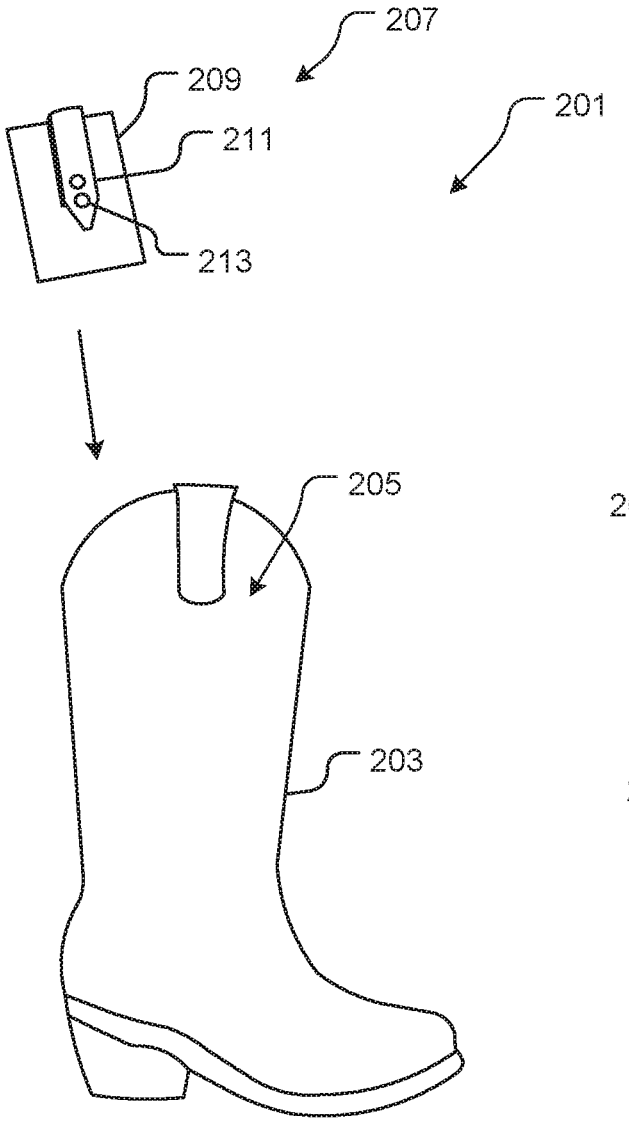
FIGS. 2A and 2B are side views of a boot storage attachment system in accordance with a preferred embodiment of the present application.
Figure 2B:
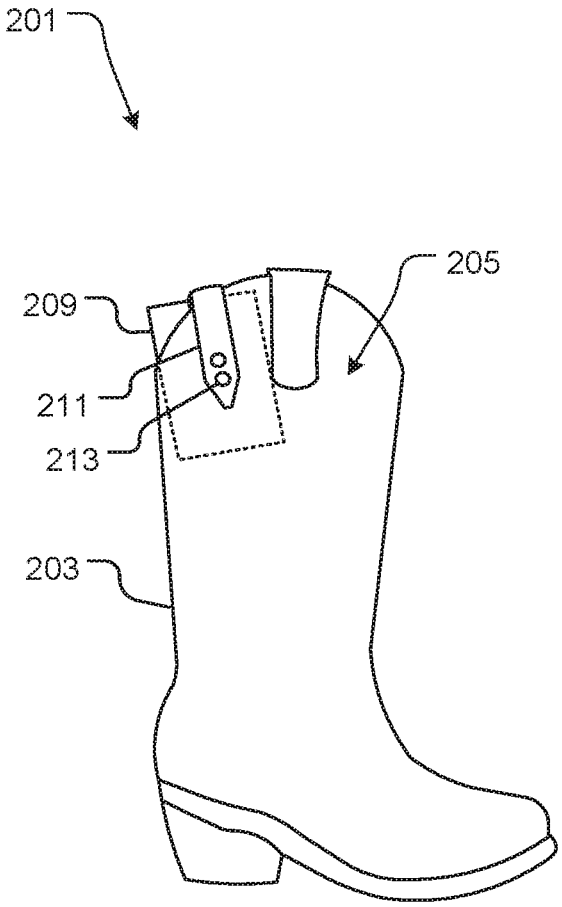

Referring now to the drawings wherein like reference characters identify corresponding or similar elements throughout the several views, FIGS. 2A and 2B depict side views of a boot storage attachment system 201 in accordance with a preferred embodiment of the present application. It will be appreciated that system 201 overcomes one or more of the above-listed problems commonly associated with conventional boot and storage systems.

In the contemplated embodiment, system 201 includes a boot 203 with an interior cavity 205 and an attachment device 207 configured to secure to the boot to provide a place for user's to place small items, such as a phone, keys, money, or the like.

Attachment device 207 includes a body 209 and a strap 211 configured to fold over the top of boot 203 to secure the body 209 inside or outside the boot, (the configuration having the body inside the boot is shown in FIG. 2B). One or more closures 213 are configured to secure to the strap 211 in place and the body 209 within the boot or to the outside of the boot.

Figure 3A:
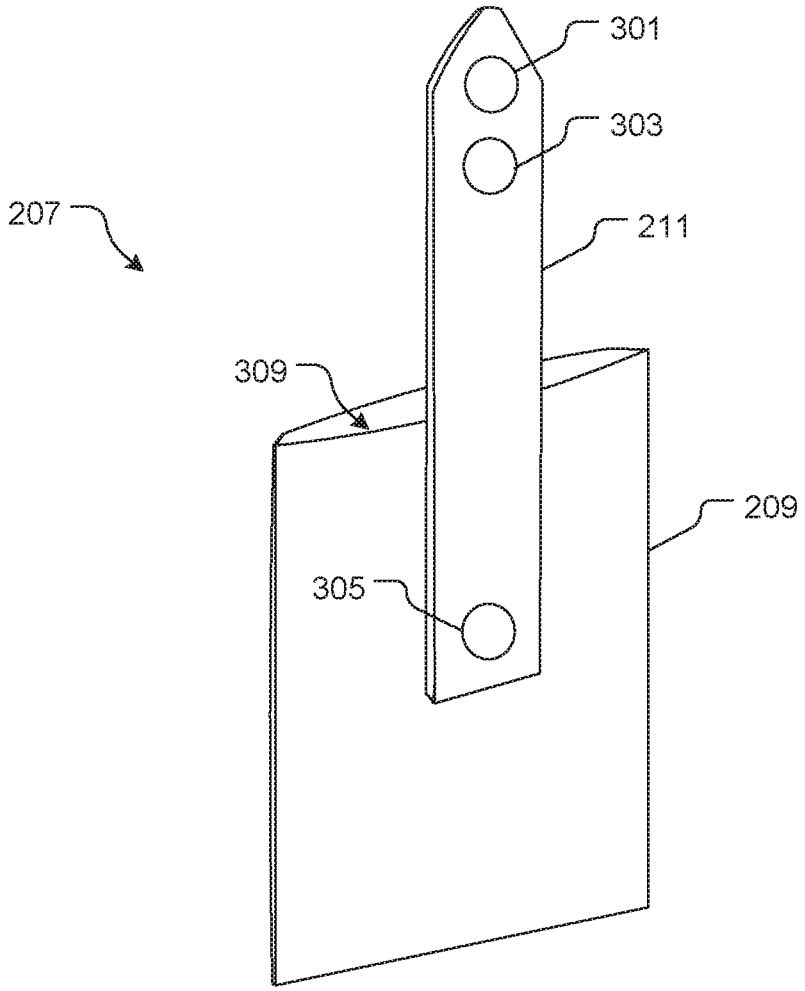
FIGS. 3A and 3B are oblique views of the attachment device of FIGS. 2A and 2B.
Figure 3B:
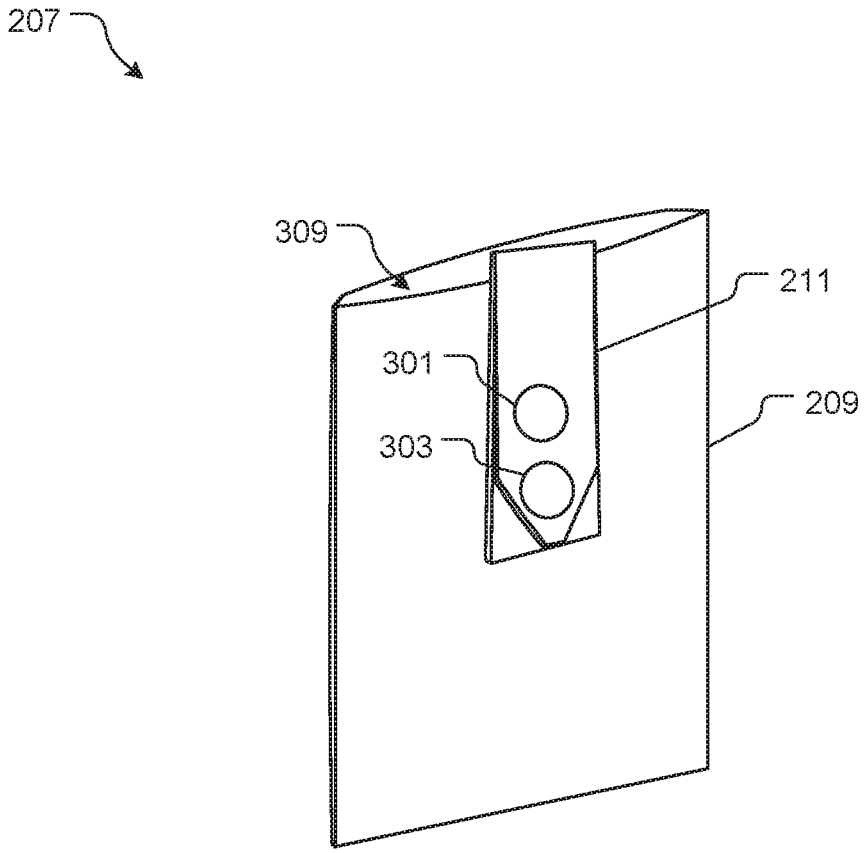

As further shown in FIGS. 3A and 3B, the closure can include one or more magnets 301, 303, 305 configured to secure the strap in place over the boot, however, it should be appreciated that other means could be used to achieve the same function. Further, as shown in FIGS. 3A and 3B, the body 209 includes an inner cavity 309 for receiving items therein. It must be understood that the shape of the strap and dimensions of the body and strap can vary as desired for aesthetical, functional, or manufacturing considerations. As shown in FIG. 3B, the strap folds over itself to secure over the top of the boot via magnetic retention, or any other means. It should further be appreciated that attachment device 207 can vary in materials, including leathers, plastics, and synthetics.

It should be appreciated that one of the unique features believed characteristic of the present application is the configuration of the attachment device 207 being configured to secure to a top of a boot via a strap, wherein the body of the attachment device can be secured within the interior of the boot. This feature allows for a user to easily and securely carry one or more items.

Figure 4:
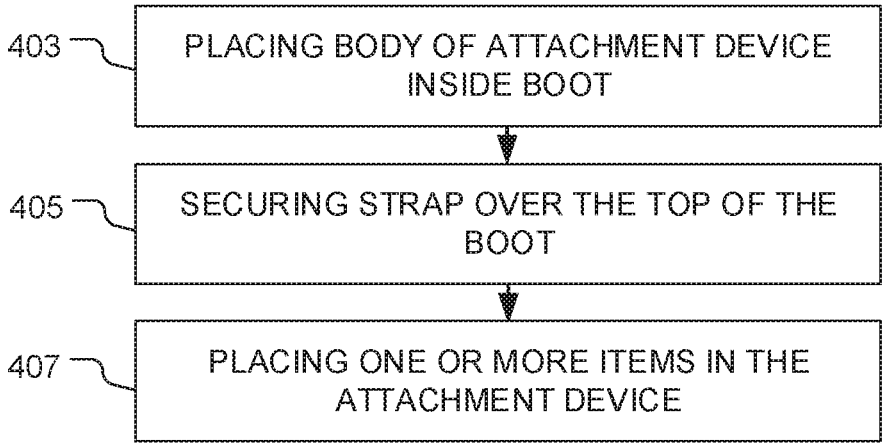
FIG. 4 is a flowchart of the method of use of the system of FIGS. 2A and 2B.

In FIG. 4, a flowchart 401 depicts a method of use of the system of the present invention. During use, the body of the device is placed inside the boot, or on the outside of the boot, and the strap is folded over the top of the boot, as shown with boxes 403, 405. The user can then place one or more items within the attachment device for storage and transportation, as shown with box 407.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A boot storage attachment system, comprising:

a boot;

a storage attachment, comprising:

a body forming an inner cavity; and a strap attached to the body, the strap extending from a first end to a second end, the first end integrally attached to the body;

a first fastener and a second fastener secured to the first end and spaced apart from each other; and a magnet secured to the second end, the magnet is configured to releasably engage with either the first fastener and the second fastener;

wherein the strap is configured to secure over a top of the boot with the body being secured within an interior of the boot or on an exterior of the boot; and wherein the magnet is configured to engage with either the first fastener and the second fastener to retain the strap over the top of the boot.

2. The system of claim 1, wherein the body and strap are integrally attached.

3. The system of claim 1, wherein the body and strap are composed of a leather.

4. A method of storing items within a boot, the method comprising:

providing the system of claim 1; and placing the body adjacent to the boot; and folding the strap over an edge of the boot;

wherein the strap secures the attachment device to the boot, wherein the body is secured adjacent to the boot.

* * * * *